United States Patent [19]

Steinhilber et al.

[11] Patent Number: 4,731,511

[45] Date of Patent: Mar. 15, 1988

[54] DECORATIVE WALL PLATES AND SLIDER CAPS FOR TOGGLE-TYPE ELECTRICAL SWITCHES

[76] Inventors: Budd Steinhilber, 77-6460 Pulani St., Kailua-Kona, Hi. 96740; William Goryl, 1033 Jones St., San Francisco, Calif. 94109

[21] Appl. No.: 914,173

[22] Filed: Oct. 1, 1986

[51] Int. Cl.[4] ..... H01H 3/20

[52] U.S. Cl. ..... 200/330; 200/333

[58] Field of Search ..... 200/330, 329, 331, 333, 200/334, 304; 174/66; D11/132-140

[56] References Cited

U.S. PATENT DOCUMENTS

| | | | |
|---|---|---|---|
| 2,146,146 | 2/1939 | Innis | 200/331 |
| 2,211,818 | 8/1940 | Innis | 200/331 |
| 2,382,738 | 8/1945 | Moyses | 200/330 |
| 2,515,820 | 10/1945 | Clark . | |
| 2,571,837 | 10/1951 | Coles | 200/330 |
| 2,584,883 | 2/1952 | Karsch | 200/333 |
| 2,712,582 | 7/1955 | Peretti . | |
| 3,816,686 | 6/1974 | Budd et al. . | |
| 3,892,935 | 7/1975 | Patterson . | |
| 4,105,884 | 8/1978 | Damsky . | |
| 4,427,864 | 1/1984 | Oster . | |

FOREIGN PATENT DOCUMENTS

| | | | |
|---|---|---|---|
| 968882 | 6/1975 | Canada | 174/66 |
| 1363425 | 8/1974 | United Kingdom | 174/66 |

*Primary Examiner*—Henry J. Recla
*Assistant Examiner*—Linda J. Sholl
*Attorney, Agent, or Firm*—Limbach, Limbach & Sutton

[57] ABSTRACT

A decorative wall plate and slider cap assembly is described for use with subsurface mounted, toggle-type electrical switches. The assembly provides an adapter wall plate for fastening to the switch strap. A decorative wall plate is fitted over the adapter plate to cover the fastening means and to impart a design feature to the wall plate. A rectangular opening through both plates receives the switch toggle. A slider member has two barbed spring clips which interact with rail members protruding from the face of the decorative wall plate. Upper and lower fingers, projecting rearwardly from the slider member face, act as cams to move the switch toggle in the vertical direction. A decorative slider cap fits over the slider member to give a basic geometric form to the switch toggle mechanism. Ramped projection members on the respective edges of the plates permit the member to be removably fastened for easy assembly, maintenance and change.

10 Claims, 9 Drawing Figures

DECORATIVE WALL PLATES AND SLIDER CAPS FOR TOGGLE-TYPE ELECTRICAL SWITCHES

TECHNICAL FIELD

This invention relates generally to plates for covering subsurface mounted electrical switches, and more particularly to decorative wall plates and slider caps for electrical switches which enhance aesthetic and functional aspects of conventional toggle-type electrical switches.

BACKGROUND OF THE INVENTION

Electric switch design standards have progressed only slightly in the last fifty years. The conventional subsurface mounted switch box has been used widely due to its safety and simplicity. The number of such units installed in the United States alone is in excess of hundreds of millions. Although this toggle-type electrical switch has become a familiar aspect of everyone's life, little has been done to enhance the aesthetics of this dull and pedestrian system. Instead these million switches are now covered by a simple slotted, flat plate which covers the switch box yet permits access to the toggle for operation. While this simplicity has many commendable features, it certainly is not even a minor element of the design of a room, home, office or building.

The present invention allows the consumer to transform their conventional wall plates and toggles into imaginative but utilitarian "wall sculptures". According to the present invention, slider caps are provided in a variety of shapes or forms, as well as colors, to cover the toggle and to create a range of decorative choices to meet the preferences of individual consumers in the decoration of their room interiors. Adapting the wall plate/slider cap of the instant invention to an existing wall switch is a simple, do-it-yourself retrofit. It only involves removing the existing wall plate, fastening the adapter plate in its place and snapping decorative cover and slider cap into place. Mounting screws, visible in conventional systems, are now hidden by the decorative cover.

Wall plates according to the instant invention are not limited to a single switch configuration. They can be molded in two, three or four (gang) switch configurations. In these multiple switch configurations, decorative slider caps can be mixed or matched in shape or color for greater variety. The ability to use different shapes and colors for these oversize caps on gang switch configurations might also prove to be a benefit to visually-impaired or physically handicapped persons in identifying or activating these switches.

It is therefore an object of this invention to provide enhanced design features to the use of the subsurface mounted, toggle-type electrical switch.

It is an object of this invention to provide a decorative wall plate which hides the screws used to mount the cover plate over the switch box and which can be easily modified to match or to contrast with the surrounding surface.

It is a further object of this invention to provide decorative slider caps to cover the conventional switch toggle member with geometric forms.

It is still another object of this invention to provide transparent members to permit the user to design his/her own wall plate and slider cap.

It is yet another object of this invention to provide compound geometric slider caps for multiple toggle-type electrical switches.

These and further objects of the invention will become apparent to those skilled in the art by reference to the below described figures and specification.

SUMMARY OF THE INVENTION

Decorative wall plates and slider caps are provided for subsurface mounted, toggle-type electrical switches which comprise an adapter wall plate having a substantially rectangular front face and four edges extending perpendicular to, and rearwardly from, said adapter wall plate front face, said plate having at least one elongate, rectangular opening therethrough for receiving a switch toggle and at least two apertures through said face for receiving a means to fasten said plate to an electrical switch housing and wherein at least two ramped projection members are disposed on outside faces of said adapter wall plate edges, said adapter wall plate being raised from said mounting surface by said edges;

a decorative wall plate having a substantially rectangular decorative front face and four edges extending perpendicular to, and rearwardly from, said decorative wall plate front face, said decorative wall plate face having at least one elongate rectangular opening therethrough for receiving a switch toggle and said opening defined along its longitudinal edges by two rail members extending perpendicularly outward from said decorative wall plate face and wherein at least two ramped projection members are disposed on the inside faces of said decorative wall plate edges to mate with said adapter wall plate edge projection members whereby said decorative wall plate is removably fastened over said adapter wall plate to align said decorative wall plate switch toggle receiving opening with said adapter wall plate switch toggle receiving opening;

at least one slider member having a front face, at least two apertures therethrough and upper and lower fingers extending perpendicular to, and rearwardly from, said slider member face which fingers act as a cam to restrict movement of said switch toggle, said sliding member also having two barbed spring clips extending perpendicular to, and rearwardly from, said slider member face for slidingly engaging said decorative wall plate rails whereby said slider member fingers and barbed spring clips receive and contain movement of said switch toggle and whereby said slider member face is permitted to move in a single plane parallel to said decorative wall plate face but is restricted in movement perpendicular to said decorative wall plate face; and, at least one decorative slider cap, larger than said slider member, having a decorative face and at least two prongs extending perpendicular to and rearwardly from, said decorative face whereby said prongs permanently mate with and assemble to said slider member face apertures.

In another embodiment, certain of the elements are translucent to enable the use of decorative inserts which enhance the versatility of the device by permitting the user to change the appearance of the decorative wall plate and slider cap at will.

DETAILED DESCRIPTION OF THE INVENTION

Figure 1:
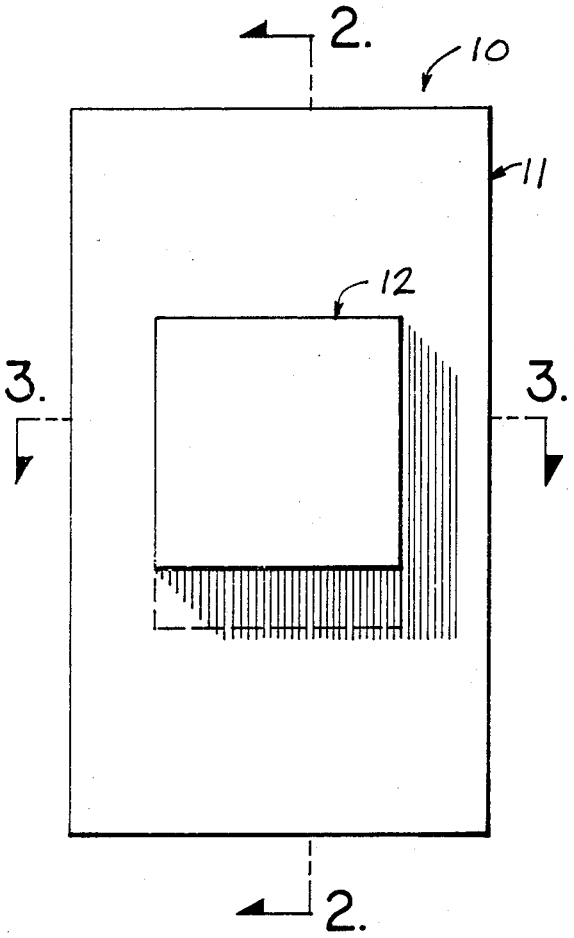
FIG. 1 is a front elevational view of the decorative wall plate and slider cap.

Referring now to FIG. 1, a decorative wall plate and slider cap 10 is shown in front elevation. A decorative wall plate 11 and decorative slider cap 12 illustrate the design simplicity of the present invention. The decorative slider cap 12 can be any of a number of geometric forms, e.g., circular, triangular and square. Other more exotic and possibly non-geometric forms having flat or contoured surfaces are also possible. It is possible for the cap 12 to take "three dimensional" form, that is having extended, contoured surfaces, e.g. as in a sphere or heart-shape. It is also contemplated that novelty items such as, e.g. cartoon characters, might be used. Although the description here is made with reference to an embodiment which has a single toggle-type electrical switch and a square slider cap 12, this description is for purposes of illustration and is not intended to limit the scope of the claims.

Figure 2:
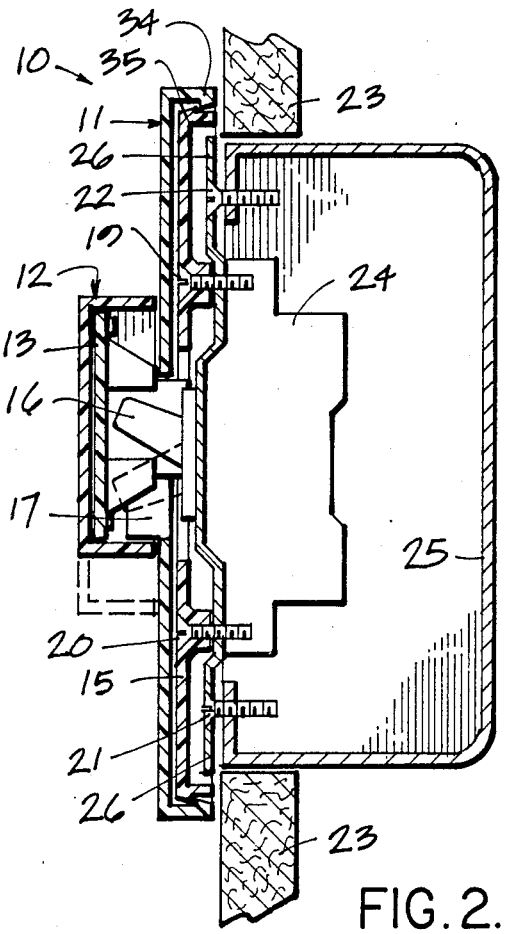
FIG. 2 is a vertical cross section of the adapter wall plate, decorative wall plate, slider member and slider cap, taken along the line 2—2 in FIG. 1, including the subsurface mounted, toggle-type electrical switch and switch housing.

The vertical cross-section of FIG. 2 shows the relationship of the decorative wall plate and slider cap 10 to its working environment. A slider member 13 is provided to act upon the mechanisms of the toggle-type electrical switch. An adapter wall plate 15 is held inside the decorative wall plate 11. A switch toggle 16 protrudes through an opening in the adapter wall plate 15. Slider member 13 acts as a cam to exert vertical force upon the switch toggle 16. Rail members 17 and 18 are part of the decorative wall plate 11 serving to guide the vertical movement of slider member 13.

Typically, machine-screw fasteners 19 and 20 join the adapter wall plate 15 to the toggle-type electrical switch mounting strap 26. Machine-screw fasteners 21 and 22 join the switch mounting strap 26 to the switch housing 25. A toggle-type electrical switch 24 is mounted so that its front face is substantially coincident with the mounting surface 23, in this case, a wallboard. The electrical switch 24 is contained within a switch housing 25, which has a substantially open side facing outwardly from the mounting surface. This opening serves to accept the toggle-type electrical switch 24 and to provide access for use and maintenance.

In the preferred embodiment of the invention, the adapter wall plate 15 has two screw receiving apertures and is fastened to the switch mounting strip 26 via machine screws 19 and 20. The adapter wall plate 15 has edges extending perpendicular to, and rearwardly from, its front face. The result of these edges is to raise the adapter wall plate 15 off of the mounting surface 23. The adapter wall plate 15 thereby serves to cover the mounting strap 26 and its fasteners 21 and 22 and to form a base for the design elements of the instant invention. The adapter wall plate 15 also has a rectangular opening in its face to receive the electrical switch toggle 16. The opening in the adapter wall plate 15 must be large enough to permit the switch toggle 16 to move throughout its total arc between "on" and "off" positions.

Figure 3:
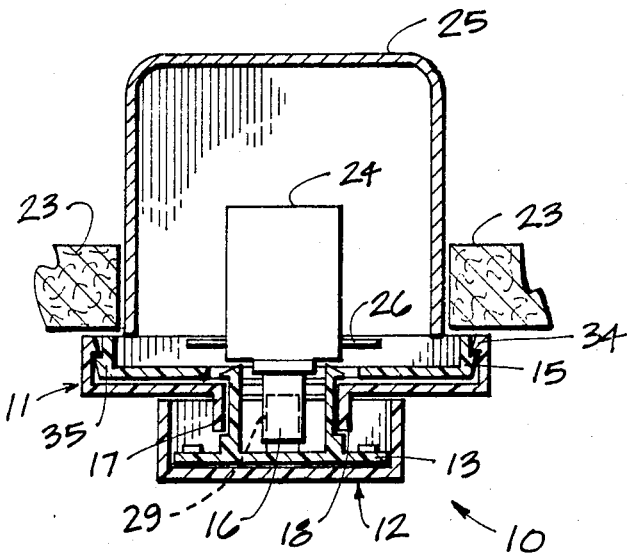
FIG. 3 is a horizontal cross section of the adapter wall plate, decorative wall plate, slider member and slider cap, taken along the line 3—3 in FIG. 1, including the subsurface mounted, toggle-type electrical switch and switch housing.

The decorative wall plate 11 is slightly larger than the adapter wall plate 15. The decorative wall plate 15 has edges extending perpendicular to, and rearwardly from, its face. The interaction of the decorative wall plate 11 and adapter wall plate 15 is more completely set forth below, with reference to FIGS. 6 and 7; here, it suffices to say that the decorative wall plate is configured to fit over the adapter wall plate 15, covering the machine screws 19 and 20 which would typically be exposed. The decorative wall plate 11 has an elongate rectangular opening on its face for receiving the electrical switch toggle 16. When the decorative wall plate 11 is fit over the adapter wall plate 15, the switch toggle-receiving opening in each plate is aligned with the other. Referring now to FIG. 3, the horizontal cross section, rail member 17 can be seen disposed along the longitudinal edges of the decorative wall plate toggle-receiving opening. A similar rail member 18 is provided on the other longitudinal edge. In the view of FIG. 3, the switch toggle 16 is shown between the two rail members; lower finger 29 is shown partially in broken lines below the toggle 16. The upper finger 27 is not shown in this view. Thus, decorative wall plate 11 has at least two rail members which protrude from the front surface on either side of the toggle-receiving slot. See FIGS. 6 and 7.

Figure 4:
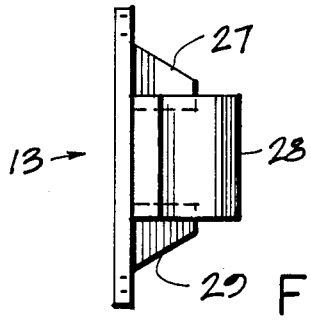
FIG. 4 is a side view of the slider member.

Slider member 13 is best described with reference to FIGS. 4 and 5. In the preferred embodiment, slider member 13 has a square front face from which fingers 27 and 29 and barbed spring clip members 28 and 30 extend perpendicularly and rearwardly. Fingers 27 and 29 act as cams to transmit vertical force to the switch toggle which is received in the space defined by the fingers and barbed spring clips when assembled. In this embodiment, the finger 27 and 29 have ramped surfaces in the cross-section shown in FIG. 4. This shape is not critical to slider member 13 operation. Injection molding requirements may dictate a different shape. The slider member 13 face has at least two apertures therethrough for mating and assembling with decorative slider cap 12.

Figure 5:
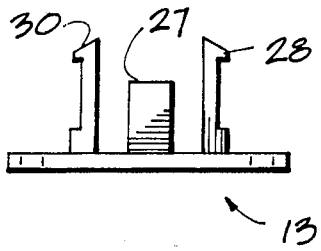
FIG. 5 is a top view of the slider member.

FIG. 5 shows the functional features of the spring clips 28 and 30. The tips of the barbed spring clips are beveled so that they may be easily inserted into the rectangular openings in the decorative wall plate 11 and adapter wall plate 15. When the unit 10 is completely assembled, the channels created on the outward faces of the spring clips 28 and 30 are intended to accept the rail members 17 and 18 disposed along the longitudinal edges of the rectangular, switch toggle-receiving opening in the decorative wall plate. As seen more completely in FIG. 3, the spring clips 28 and 30 are inserted on the inside of the rail members 17 and 18. This relationship permits the slider member 13 to move vertically within a range defined by the upper and lower fingers 27 and 29 and the rectangular switch toggle-receiving opening, while restricting movement of the slider member 13 in the horizontal plane perpendicular to the wall plate faces.

As can be seen clearly in FIGS. 2 and 3, the decorative slider cap 12 fits over the slider member 13. In this embodiment, the decorative slider cap 12 is substantially square, but this is not intended to be a limitation, merely an example. The slider cap 12 has edges which extend perpendicular to, and rearwardly from, the slider cap 12 front face. The edges are deeper than the fingers 27 and 29 so that these fingers are not visible underneath the cap 12. In this embodiment, heat-fastening prongs extend rearwardly from inside the front face of the decorative slider cap 12. These prongs are inserted in the slider member face 13 apertures to permanently fasten the slider cap 12 to the slider member 13. Thus, decorative slider cap 12 and slider member 13 act as a single unit to move the switch toggle 16 up and down thereby operating the toggle-type electrical switch.

Figure 6:
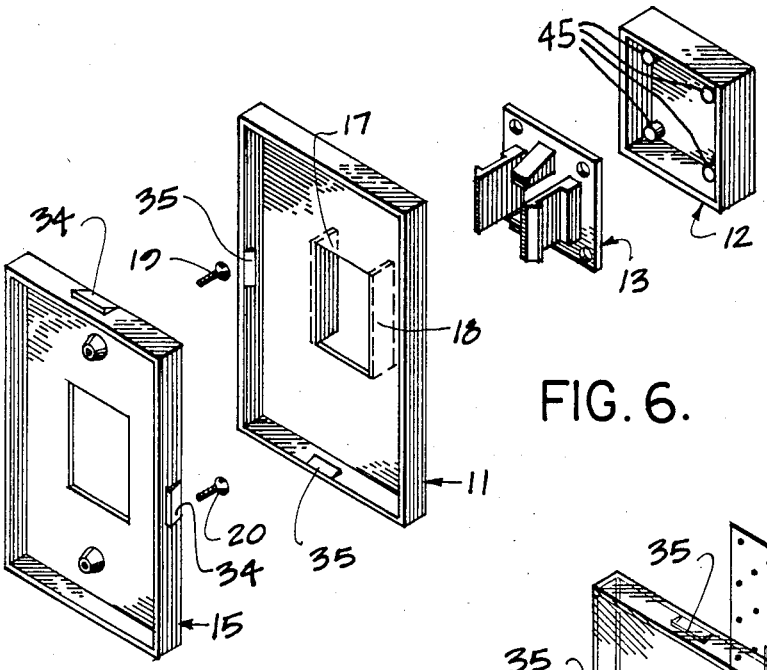
FIG. 6 is an exploded view of one embodiment of the decorative wall plate and slider cap.

FIG. 6 is an exploded view of the decorative wall plate and decorative slider cap according to a preferred embodiment of the instant invention. The decorative slider cap 12 is shown having four prongs 45 on the inside face which cooperate to fasten the slider cap 12 over the slider member 13. Decorative wall plate 11 has two rail members 17 and 18 which are received within the channels of the barbed spring clips extending rearwardly from the slider member 13. Also shown in this view are outside ramped projection members 34 disposed along the outside faces of the adapter wall plate 15 edges. Similar ramped projection members 35 are provided on the inside faces of the decorative wall plate 11. These members 34 and 35 interact to removably fasten the decorative plate 11 over the adapter plate 15. This relationship can be seen in FIGS. 2 and 3 wherein the ramped projection members 34 and 35 are disposed against each other.

The materials used to construct the various elements of the plates and caps must be chosen mindful of safety requirements. Due to the nature of uses to which such plates and caps will be put, fire resistant materials should be used. Various plastics are known in the industry to impart fire resistance. Some of the more common thermoset electrical insulating materials are phenolic, urea or alkyd compounds. Thermoplastics such as phenyline oxides or polyesters with retardants may also be used.

In the embodiment described and shown in FIGS. 1 through 6, the decorative wall plate 11 and the decorative slider cap 12 are the "decorative" elements. That is, the outward faces of these members are colored or shaped to give the desired design. These faces can have solid colors, textures, stripes, designs or whatever surface appearance is desired. As noted above, novelty elements may also be included. The critical limitation of these two design elements is that the wall plates must be large enough to cover the electrical switch housing and the slider cap must be large enough to cover the slider member and decorative wall plate, switch toggle-receiving opening.

Figure 7:
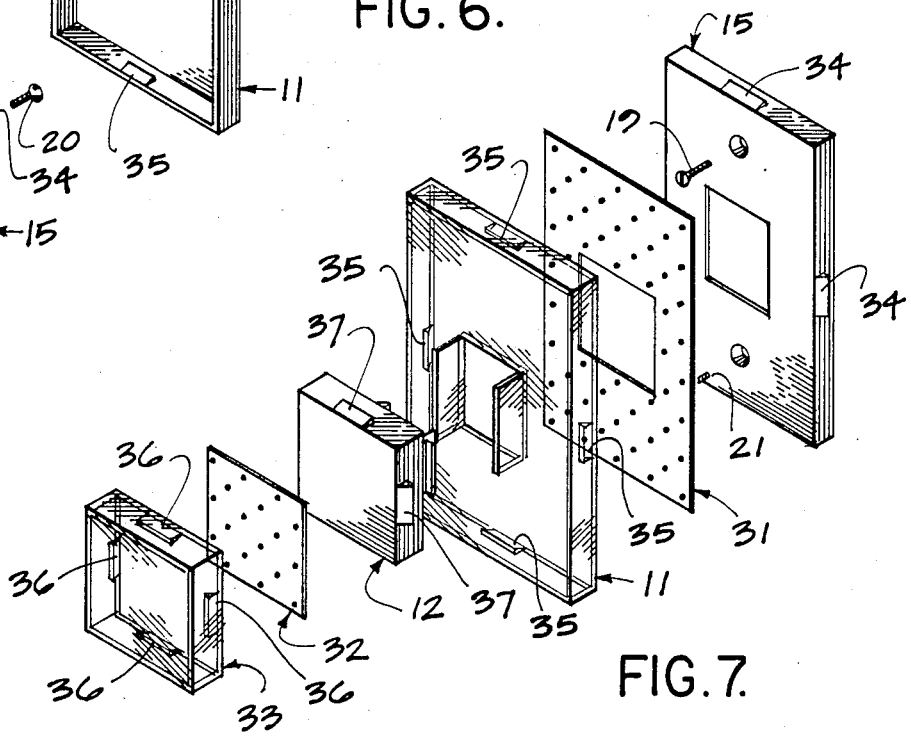
FIG. 7 is an exploded view of another embodiment of the decorative wall plate and slider cap.
Figure 9:
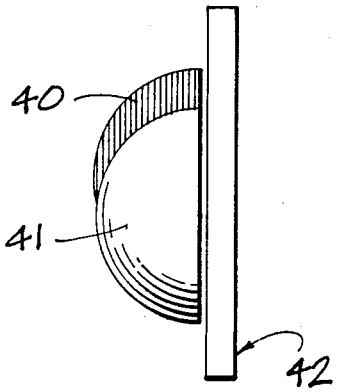
FIG. 9 is a side elevation of the compound geometric decorative wall plate and slider caps of FIG. 8.

Another embodiment of the present invention is shown in an exploded view in FIG. 7. The wall plate 11 and slider cap cover 33 are translucent to permit the manufacturer, distributor or consumer to incorporate their own decorative features. In this embodiment, a decorative insert member 31 is provided to go between the adapter wall plate 15 and a translucent wall plate 11. This decorative insert member 31 must be no larger than the adapter wall plate 15 face if it is to fit inside of translucent wall plate 11. The decorative insert member 31 must also contain a rectangular opening for receiving the switch toggle and slider member. This insert, for one example, could be a piece of wallpaper which would create the effects of the wall plate matching a background wallpaper, or, for example, an insert to label switch function. A slider cap decorative insert member 32 is provided to fit between a translucent slider cap cover 33 and the slider cap 12. This insert member 32 can be the same design, color or pattern as insert member 31, or it can be totally different. The removable nature of the translucent slider cap cover 33 and the translucent wall plate 11 makes changing the decorative inserts very simple. In addition to the ramped projection members 34 and 35 used to removably fasten the decorative wall plate 11 to the adapter wall plate 15 in the preferred embodiment, this "translucent" embodiment utilizes ramped projection members 36 and 37 to fasten the translucent slider cap cover 33 to the slider cap 12. These ramped projection members 36 and 37 work in the same way as members 34 and 35, previously described.

Translucent is used here to encompass transparent materials, smoky materials, tinted materials and other gradations of light transmitting materials. The intent is for the decorative element contained on the decorative inserts to be seen through the wall plate and slider cap covers.

Figure 8:
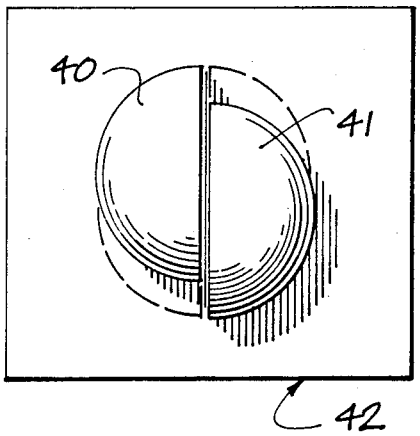
FIG. 8 is a front elevation of a decorative wall plate and decorative slider caps which cooperate to form a single basic geometric shape.

As noted above, the present invention has been described with reference to a single toggle unit by way of example only. It will be recognized by those skilled in the art that the same principles can be used in multiple switch installations without straying from the spirit of the claims set forth below. The presence of multiple switches creates an additional design feature. FIG. 8 shows one example of a compound design element wherein decorative slider caps 40 and 41 are related so as to form a single geometric form; a hemisphere. It can be seen in FIG. 8 that the adapter and decorative wall plates 42, for use with multiple switch installations, would be correspondingly wider, with multiple openings to accommodate multiple switch toggles.

A great variety of other flat or compound geometric or non-geometric forms can be developed for the decorative slider cap. Contoured as used herein refers to the surface of said shape, as in said hemisphere described above. It is possible, for example, to utilize novelty items such as three dimensional depictions of cartoon characters, hearts, dice or abstract items. Each of these decorative elements can be accommodated by the decorative slider cap.

Although this invention has been described with respect to preferred embodiments, it will be apparent to those skilled in the art that modifications and changes can be made to these embodiments which are still within the scope of the claims.

We claim:

1. Decorative wall plate and slider caps for subsurface mounted, toggle-type electrical switches which comprise:

an adapter wall plate having a substantially rectangular front face and four edges extending perpendicular to, and rearwardly from, said adapter wall plate front face, said adapter wall plate having at least one elongate, rectangular opening therethrough for receiving a switch toggle and at least two apertures through said face for receiving a means to fasten said adapter wall plate to an electrical switch housing and wherein at least two ramped projection members are disposed on outside faces of said adapted wall plate edges, said adapter wall plate being raised from said mounting surface by said edges;

a decorative wall plate having a substantially rectangular decorative front face and four edges extending perpendicular to, and rearwardly from, said decorative wallplate front face, said decorative wall plate face having at least one elongate rectangular opening therethrough for receiving a switch toggle and said opening defined along its longitudinal edges by two rail members extending perpendicularly outward from said decorative wall plate face and wherein at least two ramped projection members are disposed on the inside faces of said decorative wall plate edges to mate with said adapter wall plate edge projection members whereby said decorative wall plate is removably fastened over said adapter wall plate to align said decorative wall plate switch toggle receiving opening with said adapter wall plate switch toggle receiving opening, said decorative wall plate switch toggle receiving opening being smaller than the adapter wall plate switch toggle receiving opening;

at least one slider member having a front face, at least two apertures therethrough and upper and lower fingers extending perpendicular to, and rearwardly from, said slider member face which fingers act as a cam to restrict movement of said switch toggle, said slider member also having two barbed spring clips extending perpendicular to, and rearwardly from, said slider member face for slidingly engaging said decorative wall plate rail members whereby said slider member fingers and barbed spring clips are received within said decorative wall plate switch toggle receiving opening and thereby contain movement of said switch toggle and said slider member face is permitted to move in a single plane parallel to said decorative wall plate face but is restricted in movement perpendicular to said decorative wall plate face; and, at least one decorative slider cap, larger than said slider member, having a decorative face and at least two prongs extending perpendicular to and rearwardly from, said decorative face whereby said prongs permanently mate with, and assemble to said slider member face apertures.

2. Decorative wall plate and slider caps as in claim 1 wherein said decorative slider cap face has a shape selected from the group consisting of square, triangular, circular or other regular geometric forms.

3. Decorative wall plate and slider caps as in claim 1 wherein said decorative slider cap face comprises a novelty element.

4. Decorative wall plate and slider caps as in claim 1 wherein said decorative slider cap face has a contoured surface.

5. Decorative wall plate and slider caps as in claim 1 wherein at least two decorative slider cap faces cooperate to create a single form.

6. A decorative wall plate and slider cap for subsurface mounted, toggle-type electrical switches which comprise:

an adapter wall plate having a substantially rectangular front face and four edges extending perpendicular to, and rearwardly from, said adapter wall plate front face, said adapter wall plate having at least one elongate rectangular opening therethrough for receiving a switch toggle and at least two apertures through said face for receiving a means to fasten said adapter wall plate to an electrical switch housing and wherein at least two ramped projection members are disposed on outside faces of said adapter wall plate edges, said adapter wall plate being raised from said mounting surface by said edges;

a thin wall plate decorative insert member, not larger in size than said adapter wall plate front face, having at least one elongate rectangular opening therethrough for receiving a switch toggle;

a translucent wall plate having a translucent, substantially rectangular front face and four edges extending perpendicular to, and rearwardly from, said translucent wall plate front face, said translucent wall plate front face having at least one elongate rectangular opening therethrough for receiving a switch toggle, said opening defined along its longitudinal edges by two rail members extending perpendicularly outward from said translucent wall plate face and wherein at least two ramped projection members are disposed on the inside faces of said translucent wall plate edges to mate with said adapter wall plate edge projection members whereby said decorative insert member is held between the adapter wall plate face and the translucent wall plate, said translucent wall plate being removably fastened over said adapter wall plate characterized in that said switch toggle receiving openings through said adapter and translucent wall plates and said decorative insert member are aligned and, said translucent wall plate elongate rectangular opening for receiving a switch toggle is smaller than said adapter wall plate switch toggle receiving opening;

at least one slider member having a front face and edges extending perpendicular to, and rearwardly from said slider member front face and having upper and lower fingers extending perpendicular to, and rearward from, said slider member face, which fingers act as a cam to restrict movement of said switch toggle, said slider member also having two barbed spring clips extending perpendicular to, and rearward from, said slider member face for slidingly engaging said translucent wall plate rail members whereby said slider member fingers and barbed spring clips are received within said translucent wall plate elongate rectangular openings for receiving a switch toggle and thereby contain movement of said switch toggle and said slider member face is permitted to move in a single plane parallel to said translucent wall plate face but is restricted in movement perpendicular to said transluacent wall plate face, and wherein at least two ramped projection members are disposed on the outside faces of said slider member edges;

at least one thin slider cap decorative insert member, not larger than said slider member front face; and, at least one translucent slider cap cover, adapted to removably receive said slider member front face, having a translucent front face, edges extending perpendicular to, and rearward from, said translucent slider cap cover front face and at least two ramped projection members disposed on the inside faces of said translucent slider cap cover edges to mate with said slider member edge projection members whereby said slider cap decorative insert member is held between the slider member front face and the translucent slider cap cover.

7. Decorative wall plate and slider cap covers as in claim 6 wherein said translucent slider cap cover face has a shape selected from the group consisting of square, triangular, circular or other regular geometric shapes.

8. Decorative wall plate and slider cap covers as in claim 6 wherein said translucent slider cap cover comprises a novelty element.

9. Decorative wall plate and slider cap covers as in claim 6 wherein said translucent slider cap cover has a contoured surface.

10. Decorative wall plate and slider cap covers as in claim 6 wherein at least two translucent slider cap covers cooperate to create a single form.

* * * * *